US007054565B2

(12) United States Patent
Shin

(10) Patent No.: US 7,054,565 B2
(45) Date of Patent: May 30, 2006

(54) ELECTROPHOTOGRAPHIC IMAGE FORMING APPARATUS AND METHOD OF CONTROLLING DEVELOPMENT USING INFORMATION CONCERNING REPLACEMENT OF CONSUMABLES

(75) Inventor: Kyu-cheol Shin, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 104 days.

(21) Appl. No.: 10/777,040

(22) Filed: Feb. 13, 2004

(65) Prior Publication Data

US 2004/0184825 A1 Sep. 23, 2004

(30) Foreign Application Priority Data

Mar. 11, 2003 (KR) ..... 10-2003-0015195

(51) Int. Cl.
*G03G 15/00* (2006.01)

(52) U.S. Cl. ..... 399/26

(58) Field of Classification Search ..... 399/26, 399/27

See application file for complete search history.

(56) References Cited

U.S. PATENT DOCUMENTS 5,761,590 A * 6/1998 Sato ..... 399/285
6,058,275 A * 5/2000 Kodama ..... 399/46
2003/0147658 A1* 8/2003 Shin et al. ..... 399/26

FOREIGN PATENT DOCUMENTS

JP 6-130767 5/1994
JP 2003215859 A * 7/2003

* cited by examiner

*Primary Examiner*—Quana Grainger
(74) *Attorney, Agent, or Firm*—Stanzione & Kim, LLP

(57) ABSTRACT

An electrophotographic image forming apparatus and a method of controlling development includes a current measuring unit to measure a developing current flowing between a developing roller and a photosensitive medium, and a controlling unit to calculate at least one of a thickness of a photosensitive film of the photosensitive medium, a thickness of a developer on a surface of the developing roller, and the quantity of development on the surface of the photosensitive medium using the measured developing current, and then display information concerning replacement of consumables, or control a developer supply vector and a development vector on a basis of the calculated value. In addition, the method of controlling development has measuring developing currents; calculating a capacitance of a photosensitive medium, the thickness of the developer, and an exposure potential of an electrostatic latent image using the measure developing currents; calculating the thickness of the photosensitive film, the thickness of the developer, and the quantity of development using the calculated values; and comparing the calculated values of the thickness of the photosensitive film, the thickness of the developer, and the quantity of development with preset standard values, respectively, and then displaying information concerning replacement of the photosensitive medium and the developer or controlling a developer supply vector and a developing vector.

35 Claims, 8 Drawing Sheets

ELECTROPHOTOGRAPHIC IMAGE FORMING APPARATUS AND METHOD OF CONTROLLING DEVELOPMENT USING INFORMATION CONCERNING REPLACEMENT OF CONSUMABLES

CROSS-REFERENCE TO RELATED APPLICATIONS

This application claims the benefit of Korean Patent Application No. 2003-15195 filed with the Korea Industrial Property Office on Mar. 11, 2003, the disclosure of which is incorporated herein by reference.

BACKGROUND OF THE INVENTION

1. Field of the Invention

The present invention relates to an electrophotographic image forming apparatus, and more particularly, to an electrophotographic image forming apparatus and a method of controlling development by obtaining information concerning consumable replacement, controlling the thickness of a developer on a surface of a developing roller, and controlling the quantity of development on a surface of a photosensitive medium.

2. Description of the Related Art

In general, an electrophotographic image forming apparatus, such as a copier or laser printer, is an apparatus in which an electrostatic latent image is formed on a photosensitive medium, such as a photosensitive drum or photosensitive belt, the electrostatic latent image is developed by predetermined color developers, and the developed image is transferred to a sheet of print paper so that a desired image can be obtained.

Such electrophotographic image forming apparatuses are classified into dry type ones and wet type ones according to developers used therein. A powder toner is used as a developer in the dry type ones and a liquid developer made by mixing a liquid carrier and a toner is used in the wet type ones.

FIG. 1 is a diagram schematically illustrating a structure of a conventional electrophotographic image forming apparatus.

Referring to FIG. 1, the conventional electrophotographic image forming apparatus has a photosensitive medium 10, a charging roller 20, an exposure unit 30, a developing roller 40, a supplying roller 50, and a transfer roller 60.

The photosensitive medium 10 has a structure in which a photosensitive film 12 is formed around the outer circumference of a metallic drum 11. A surface of the photosensitive medium 10 is charged to a predetermined voltage by the charging roller 20, and an electrostatic latent image is formed by light illuminated by the exposure unit 30 on the charged surface of the photosensitive medium 10. In addition, a charge eraser 14 discharging charges on the surface of the photosensitive medium 10, and a cleaning blade 16 removing a remaining toner from the surface of the photosensitive medium 10 are disposed in the vicinity of the photosensitive medium 10.

A predetermined color developer of color developers, for example, a toner, is applied by the developing roller 40 to the electrostatic latent image formed on the surface of the photosensitive medium 10, and, accordingly, the electrostatic latent image is developed as a desired image. At this time, the toner is supplied by the supplying roller 50 from a developer container 52 to a surface of the developing roller 40, and then is transferred to the surface of the photosensitive medium 10 by the developing roller 40. Such transfer of the toner is achieved by a first potential difference between the supplying roller 50 and the developing roller 40 and a second potential difference between the developing roller 40 and the electrostatic latent image formed on the surface of the photosensitive medium 10.

The developed image on the surface of the photosensitive medium 10 is transferred to a print paper P by the transfer roller 60.

However, in the conventional image forming apparatus having the above-described structure, as the accumulated total number of printed papers increases, the quantity of the toner contained in the developer container 52 decreases, and characteristics of the photosensitive film 12 formed on the surface of the photosensitive medium 10 deteriorate. In addition, a thickness of the photosensitive film 12 is gradually reduced since the surface of the photosensitive medium 10 is abraded by the blade 16 cleaning the surface of the photosensitive medium 10. When the quantity of the toner contained in the developer container 52 decreases as mentioned above, the quantity of the toner supplied from the supplying roller 50 to the developing roller 40 is decreased. When the characteristics of the photosensitive film 12 deteriorate, an exposure potential of the electrostatic latent image is changed. When the thickness of the photosensitive film 12 is reduced, a capacitance of the photosensitive film 12 is changed, thereby changing a developing current. When the quantity of development on the surface of the photosensitive medium 10 is changed, there occurs a problem in that concentration of the image transferred to the print paper P becomes inhomogeneous, and the quality of an image deteriorates. Here, the quantity of development is defined as the quantity of a developer per unit area of the surface of the photosensitive medium 10.

Therefore, in the conventional electrophotographic image forming apparatus, even when the quantity of the toner decreases, or the characteristics of the photosensitive film 12 deteriorate, the quantity of development needs to be controlled so that homogeneous concentration of an image can be obtained. In addition, it is necessary to detect whether or not the toner is exhausted, whether the thickness of the photosensitive film 12 is decreased, and the likeso that the developer container 52 can be replenished with new toner and the photosensitive medium 10 can be replaced with a new one in advance.

Although apparatuses and methods of controlling the quantity of development and obtaining information concerning replacement of consumables have been proposed, the apparatuses and methods have drawbacks in that they require many sensors and devices and complex processes.

SUMMARY OF THE INVENTION

To solve the above-described and/or other problems, it is an object of the present invention to provide an electrophotographic image forming apparatus and a method which are capable of measuring a developing current flowing between a developing roller and a photosensitive medium so that information concerning replacement of the photosensitive medium and a developer can be obtained by one or more values of the measured developing current, and controlling the thickness of the developer formed on the surface of the developing roller and the quantity of development on the surface of the developing roller.

Additional aspects and/or advantages of the invention will be set forth in part in the description which follows and, in part, will be obvious from the description, or may be learned by practice of the invention.

Accordingly, to achieve the above and/or other aspects of the present invention, there is provided an electrophotographic image forming apparatus comprising: a photosensitive medium; a charging unit to charge a surface of the photosensitive medium to a uniform (charged) potential; an exposure unit to scan light over the surface of the photosensitive medium to form an electrostatic latent image on the surface of the photosensitive medium; a developing roller to develop the electrostatic latent image by applying a developer to the electrostatic latent image; a developer supplying roller to supply developer to the developing roller; a transfer unit to transfer the developed image on the surface of the photosensitive medium to a sheet of print paper; a current measuring unit to measure a developing current flowing between the developing roller and the photosensitive medium, and a controlling unit to calculate a value representing at least one of the thickness of a photosensitive film of the photosensitive medium, the thickness of the developer on the surface of the developing roller, and the quantity of development on the surface of the photosensitive medium using the measured developing current, and then displaying information concerning replacement of consumables or controlling development parameters on the basis of the calculated value.

According to another aspect of the present invention, the current measuring unit is a current measuring circuit provided between the developing roller and a developing power source applying a developing potential to the developing roller.

According to yet another aspect of the present invention, the current measuring unit may measure values representing developing currents in three modes, respectively, the three measured values of the developing currents may be used in the controlling unit to calculate the thickness of the photosensitive film of the photosensitive medium, the thickness of the developer on the surface of the developing roller, and the quantity of development on the surface of the photosensitive medium.

According to still another aspect of the present invention, the controlling unit includes: a CPU which calculates desired values using at least one of the three measured values of the developing currents, decides whether the consumables must be replaced by comparing the calculated values with preset standard values, and controls the development parameters; a memory portion to store a lookup table having the preset standard values to be referenced by the CPU; and a display portion to display information concerning replacement of the consumables according to decisions of the CPU concerning whether or not the consumables must be replaced.

According to still another aspect of the present invention, the information concerning replacement of the consumables may include first information concerning replacement of the photosensitive medium and second information concerning replacement of the developer, and the development parameters may include a developer supply vector and a development vector.

In addition, to achieve the above and/or other aspects of the present invention, there are provided various methods of controlling development in an electrophotographic image forming apparatus.

In order to achieve the above and/or other aspects of the present invention, there is provided a method of controlling development in an electrophotographic image forming apparatus, the method comprising measuring a value representing a developing current flowing between a photosensitive medium and a developing roller in a state in which a surface of the photosensitive medium is charged to a charged (uniform) potential using a developing potential applied to the developing roller; calculating a capacitance of the photosensitive medium using the measured value of the developing current, the charged potential, and the developing potential; calculating the thickness of a photosensitive film of the photosensitive medium using the capacitance; comparing the thickness of the photosensitive film with a preset allowable minimum thickness; and displaying information concerning replacement of the photosensitive medium with a new one when the thickness of the photosensitive film is smaller than the allowable preset minimum thickness.

In order to achieve the above and/or other aspects of the present invention, there is also provided a method of controlling development in an electrophotographic image forming apparatus, the method comprising measuring a value representing a developing current flowing between a photosensitive medium and a developing roller in a state in which a surface of the photosensitive medium is charged to a charged (uniform) potential using a developing potential and a developer supplying potential applied to the developing roller and a developer supplying roller, respectively, so that a developer can be supplied to a surface of the developing roller; calculating a potential of the developer on the surface of the developing roller using the measured value of the developing current, the charged potential, the developing potential, and a capacitance of the photosensitive medium; calculating a thickness of the developer on the surface of the developing roller using the potential of the developer; comparing the thickness of the developer with a preset allowable minimum thickness; and displaying information concerning replacement of the developer when the thickness of the developer is smaller than the preset allowable minimum thickness.

According to another aspect of the present invention, after displaying of the information, the method further comprises: deciding whether t the thickness of the developer is within a preset standard thickness range when the thickness of the developer is the same as or thicker than the allowable minimum thickness; and controlling a developer supply vector so that the thickness of the developer can be within the standard thickness range when the thickness of the developer is out of the standard thickness range.

According to another aspect of the present invention, in the controlling operation of the developer supply vector, the developer supply vector is controlled by controlling the developer supplying potential.

According to another aspect of the present invention, in the controlling operation of the developer supply vector, the developer supply vector may be controlled using data concerning variations in the thickness of the developer with increase and decrease of the developer supply vector, wherein the data are stored in advance in a lookup table.

In order to achieve the above and/or other aspects of the present invention, there is also provided a method of controlling development in an electrophotographic image forming apparatus, the method comprising measuring a value representing a developing current flowing between a photosensitive medium and a developing roller in a state in which an electrostatic latent image is formed on the surface of the photosensitive medium, a developing potential and a developer supplying potential are applied to the developing roller and a developer supplying roller, respectively, to supply the developer to the surface of the developing roller so that the developer can be attached to the electrostatic latent image; calculating an exposure potential of the electrostatic latent image using the measured value of the developing current, the developing potential, the potential of the developer, and the capacitance of the photosensitive medium; calculating the quantity of development on the surface of the photosensitive medium using the exposure potential; deciding whether or not the quantity of development is within a preset standard range; and controlling a development vector so that the quantity of development can be within the standard range when the quantity of development is out of the standard range.

According to another aspect of the present invention, after the calculating of the exposure potential, the method further comprises comparing the exposure potential with a preset allowable maximum potential; and displaying information concerning replacement of the photosensitive medium when the exposure potential is greater than the allowable maximum potential.

According to another aspect of the present invention, in the controlling of the development vector, the development vector is controlled by controlling the developing potential.

Further, in the controlling of the development vector, the development vector may be controlled by using data representing variations in the quantity of development with respect to increase and decrease of the development vector, wherein the data is stored in advance in a lookup table.

In order to achieve the above and/or other aspects of the present invention, there is also provided a method of controlling development in an electrophotographic image forming apparatus, the method comprising measuring developing currents flowing between a photosensitive medium and a developing roller in three modes, respectively; calculating a capacitance of the photosensitive medium, the potential of a developer on a surface of the developing roller, and an exposure potential of an electrostatic latent image using measured values of the developing currents; calculating a thickness of a photosensitive film of the photosensitive medium, the thickness of the developer on the surface of the developing roller, and the quantity of development on the photosensitive medium using values calculated in the calculating operation; (d) comparing the thickness of the photosensitive film with a preset allowable minimum thickness of the photosensitive film and comparing the thickness of the developer with a preset allowable minimum thickness of the developer; displaying information concerning replacement of the photosensitive medium when the thickness of the photosensitive film is less than the allowable minimum thickness of the photosensitive film, and displaying information concerning replacement of the developer when the thickness of the developer is less than the allowable minimum thickness of the developer; deciding whether or not the quantity of development is within a preset standard range; and controlling a development vector so that the quantity of development can be within the standard range when the quantity of development is out of the standard range.

Here, the three modes may comprise: a first mode in which a surface of the photosensitive medium is charged to a charged (uniform) potential, and a developing potential is applied to the developing roller; a second mode in which a developer supplying potential is applied to a developer supplying roller so that the developer can be applied to the surface of the developing roller in addition to the state of the first mode; and a third mode in which an electrostatic latent image is formed on the surface of the photosensitive medium so that the developer can be attached to the electrostatic latent image in addition to the state of the second mode.

According to another aspect of the present invention, after the calculating operation, the method further comprises comparing the exposure potential with a preset allowable maximum potential; and displaying information concerning replacement of the photosensitive medium when the exposure potential is greater than the allowable maximum potential.

According to yet another aspect of the present invention, after the displaying operation, the method further comprises deciding whether or not the thickness of the developer is within a preset standard thickness range when the thickness of the developer is the same as or thicker than the allowable minimum thickness; and controlling a developer supply vector so that the thickness of the developer can be within the standard thickness range when the thickness of the developer is out of the standard thickness range.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
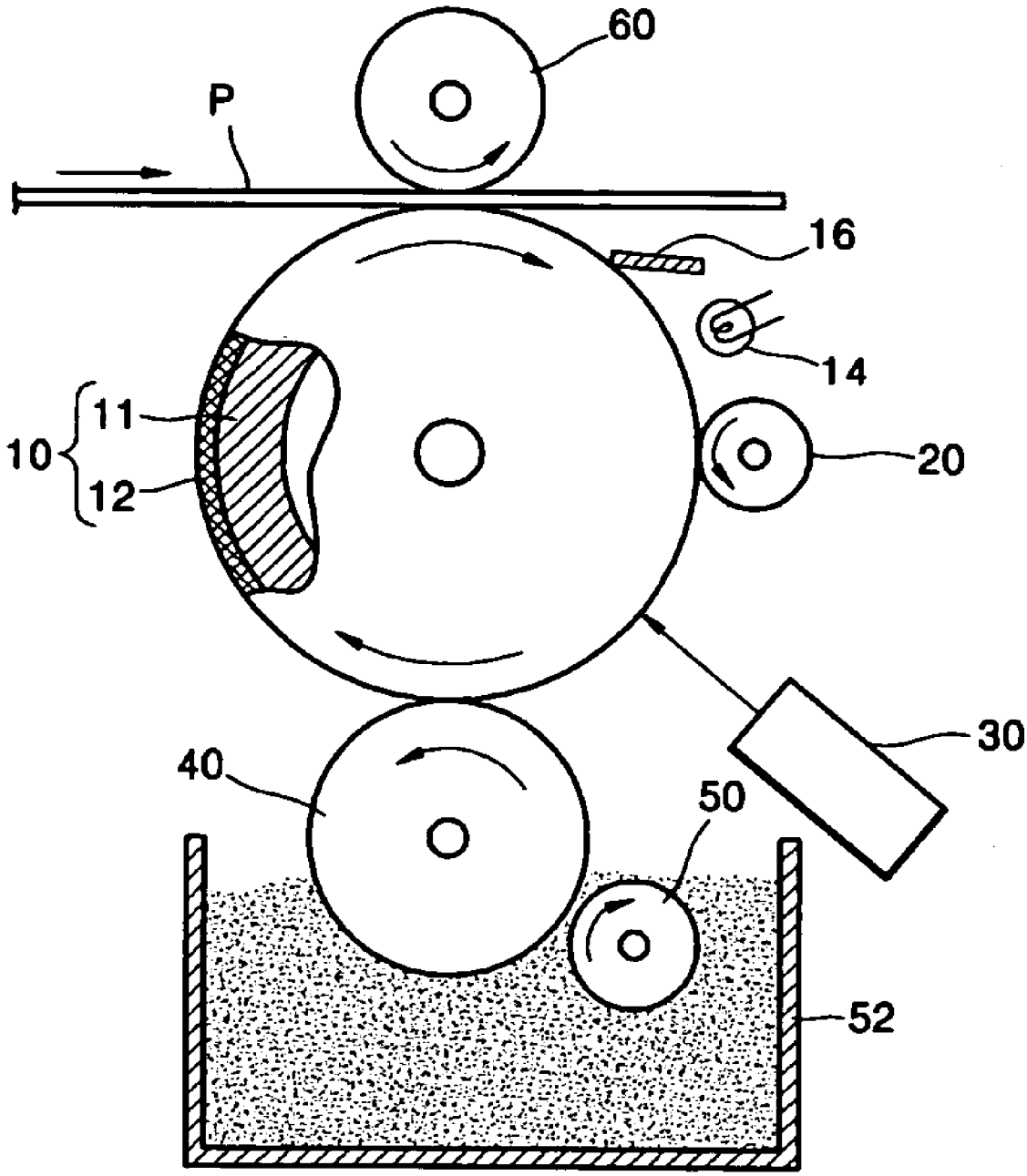
FIG. 1 (PRIOR ART)
FIG. 1 is a diagram schematically illustrating a structure of a conventional electrophotographic image forming apparatus.

The present invention can be applied to both dry type and wet type image forming apparatuses. However, as a matter of convenience of description, the present invention will be described basically by describing a dry type image forming apparatus using a powder toner as a developer. Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
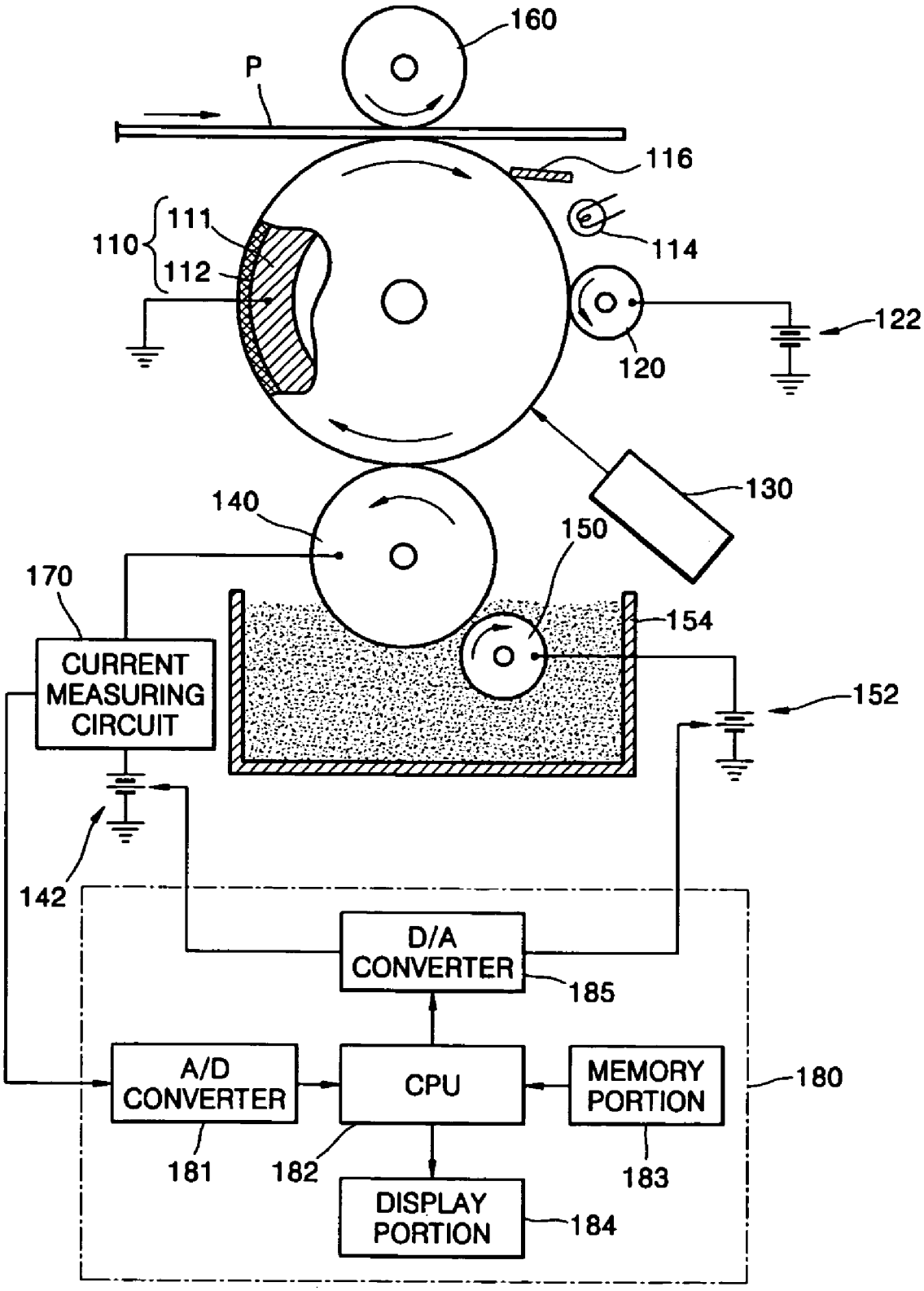
FIG. 2 is a diagram illustrating a structure of an electrophotographic image forming apparatus according to an embodiment of the present invention.

FIG. 2 is a diagram illustrating a structure of an electrophotographic image forming apparatus according to an embodiment of the present invention.

Referring to FIG. 2, the electrophotographic image forming apparatus has a photosensitive medium 110, a charging unit, an exposure unit 130, a developing roller 140, a developer supplying roller 150, a transfer unit, a current measuring unit and a controlling unit 180.

The photosensitive medium 110 has a structure in which a photosensitive film 112 made of a photosensitive material is formed on an outer circumferential surface of a metallic drum 111, and the metallic drum 111 is electrically biased or grounded. In addition, although the drum shaped photosensitive medium 110 is used in this embodiment, the photosensitive medium 111 is not limited to a drum type photosensitive medium, and a belt type photosensitive medium may be used alternatively.

In addition, in the vicinity of the photosensitive medium 110, a charge eraser 114 to erase any charge remaining on a surface of the photosensitive medium 110, and a cleaning blade 116 to clean the surface of the photosensitive medium 110 are disposed.

The charging unit is a device to charge the surface of the photosensitive medium 110 to a predetermined potential, for example, 900 volts. Hereinafter, a surface potential of the photosensitive medium 110 is referred to as a charged potential $V_{CHA}$. In this embodiment, a charging roller 120 is used as the charging unit to supply a charge to the photosensitive medium 110 while rotating together with an outer circumferential surface thereof contacting the surface of the photosensitive medium 110. Otherwise, a wire generating corona may be used as the charging unit instead of the charging roller 120. A charging power source 122 is connected to the charging roller 120.

The exposure unit 130 is a device to scan a light beam on the surface of the photosensitive medium 110 to form an electrostatic latent image. When a light beam is scanned on the surface of the photosensitive medium 110, the potential of the scanned surface is dropped to about 0~100 volts. Therefore, while the potential of an area of the surface of the photosensitive medium 110 which is not exposed to the light beam remains at the charged potential $V_{CHA}$, i.e., 900 volts, the potential of an exposed area, i.e., the area of the electrostatic latent image, is about 0~100 volts. Hereinafter, the potential of the electrostatic latent image is referred to as an exposed potential $V_{EXP}$.

The developing roller 140 is a device which applies a developer, for example, toner, to the electrostatic latent image formed on the surface of the photosensitive medium 110 so as to develop the electrostatic latent image. A developing potential $V_{DEV}$ of about 400~500 volts is applied from a developing power source 142 to the developing roller 140. The toner on a surface of the developing roller 140 is moved to the electrostatic latent image by a potential difference between the developing potential $V_{DEV}$ and the exposed potential $V_{EXP}$. The potential difference between the developing potential $V_{DEV}$ and the exposed potential $V_{EXP}$ is defined as a development vector $V_D$.

The developer supplying roller 150 is a device which is installed in a developer container 154 to be rotated to supply the toner contained in the developer container 154 to the developing roller 140. A toner supplying potential $V_{SUP}$ of about 500~700 volts is applied from a power supply source 152 to the developer supplying roller 150. The toner contained in the developer container 154 is attached to the surface of the developing roller 140 by a potential difference between the developing potential $V_{DEV}$ and the toner supplying potential $V_{SUP}$. The potential difference between the developing potential $V_{DEV}$ and the toner supplying potential $V_{SUP}$ is defined as a toner supply vector $V_S$.

In addition, though this embodiment is described on a basis in which the toner is positively charged, the toner may be negatively charged as well. When the toner is negatively charged, the above-mentioned charged potential $V_{CHA}$, exposed potential $V_{EXP}$, developing potential $V_{DEV}$, and toner supplying potential $V_{SUP}$ all have negative values.

As described above, the transfer unit is a device to transfer a developed image on the surface of the photosensitive medium 110 to a print paper sheet P, and a transfer roller 160 may be used as the transfer unit as shown in FIG. 2.

Further, the transfer unit may have an intermediate transfer belt (not shown). In this case, after the developed image on the surface of the photosensitive medium 110 is primarily transferred to the intermediate transfer belt, the transferred image on the intermediate transfer belt is transferred to the print paper sheet P by the transfer roller 160. In particular, an image forming apparatus to print a colour image usually has the intermediate transfer belt as a member of the transfer unit. In this case, a plurality of photosensitive mediums are arranged in series along a travel direction of the intermediate transfer belt, and charging units, exposure units, developing rollers, and toner supplying rollers are also disposed adjacent to respective ones of the photosensitive mediums.

The current measuring unit is a unit to measure a developing current $I_{DEV}$ flowing between the developing roller 140 and the photosensitive medium 110. In this embodiment, a current measuring circuit 170 is provided between the developing roller 140 and the developing power source 142 that applies the developing potential $V_{DEV}$ to the developing roller 140. Preferably, the current measuring circuit 170 measures developing current $I_{DEV}$ values in three modes, respectively, and the measured developing current $I_{DEV}$ values are transmitted to the controlling unit 180. The three modes will be described in detail later.

According to the developing current $I_{DEV}$ values measured at the current measuring circuit 170, the controlling unit 180 calculates at least one of a thickness of the photosensitive film 112 of the photosensitive medium 110, a thickness of the toner on the developing roller 140, and the quantity of development on the surface of the photosensitive medium 110. The quantity of the development is defined as the quantity of the toner per unit area of the electrostatic latent image formed on the surface of the photosensitive medium 110. Subsequently, the controlling unit 180 displays information concerning replacement of consumables or controls development parameters depending on the calculated value. The information concerning replacement of the consumables may include information concerning replacement of the photosensitive medium 110 and the toner. In addition, the development parameters may include the toner supply vector $V_S$ and the development vector $V_D$. When the toner supply vector $V_S$ is controlled, the thickness of the toner on the developing roller 140 can be controlled, and when the development vector $V_D$ is controlled, the quantity of development can be controlled.

To this end, the controlling unit 180 may include a CPU 182, a memory portion 183, and a display portion 184. Signals corresponding to the measured developing current $I_{DEV}$ values measured at the current measuring circuit 170 are inputted to the CPU 182 via an A/D converter 181. The CPU 182 calculates a capacitence $C_{OPC}$ of the photosensitive medium 10, a toner potential $V_{TON}$ of the surface of the developing roller 140, and the exposure potential $V_{EXP}$ of the surface of the photosensitive medium 110 by using the measured developing current $I_{DEV}$ values. Subsequently, the CPU 182 calculates the thickness of the photosensitive film 112, the thickness of the toner, and the quantity of development using the capacitance $C_{OPC}$, the toner potential $V_{TON}$, and the exposure potential $V_{EXP}$. In addition, the CPU 182 determines whether or not the consumables must be replaced by comparing the calculated values with predetermined reference values, and controls the development parameters. The memory portion 183 stores a lookup table having the reference values to be inputted to the CPU 182, and the display portion 184 displays information concerning replacement of the consumables according to determinations of the CPU 182 concerning whether or not the consumables must be replaced. A development-parameter controlling signal is transmitted from the CPU 182 to the power supply source 152 or the developing power source 142 via a D/A converter 185.

Now, in the image forming apparatus having the above-described structure, the three modes of a method of controlling development according to the present invention will be described. The three modes of the method of controlling development may be performed separately, or two or three modes may be performed together.

Figure 3:
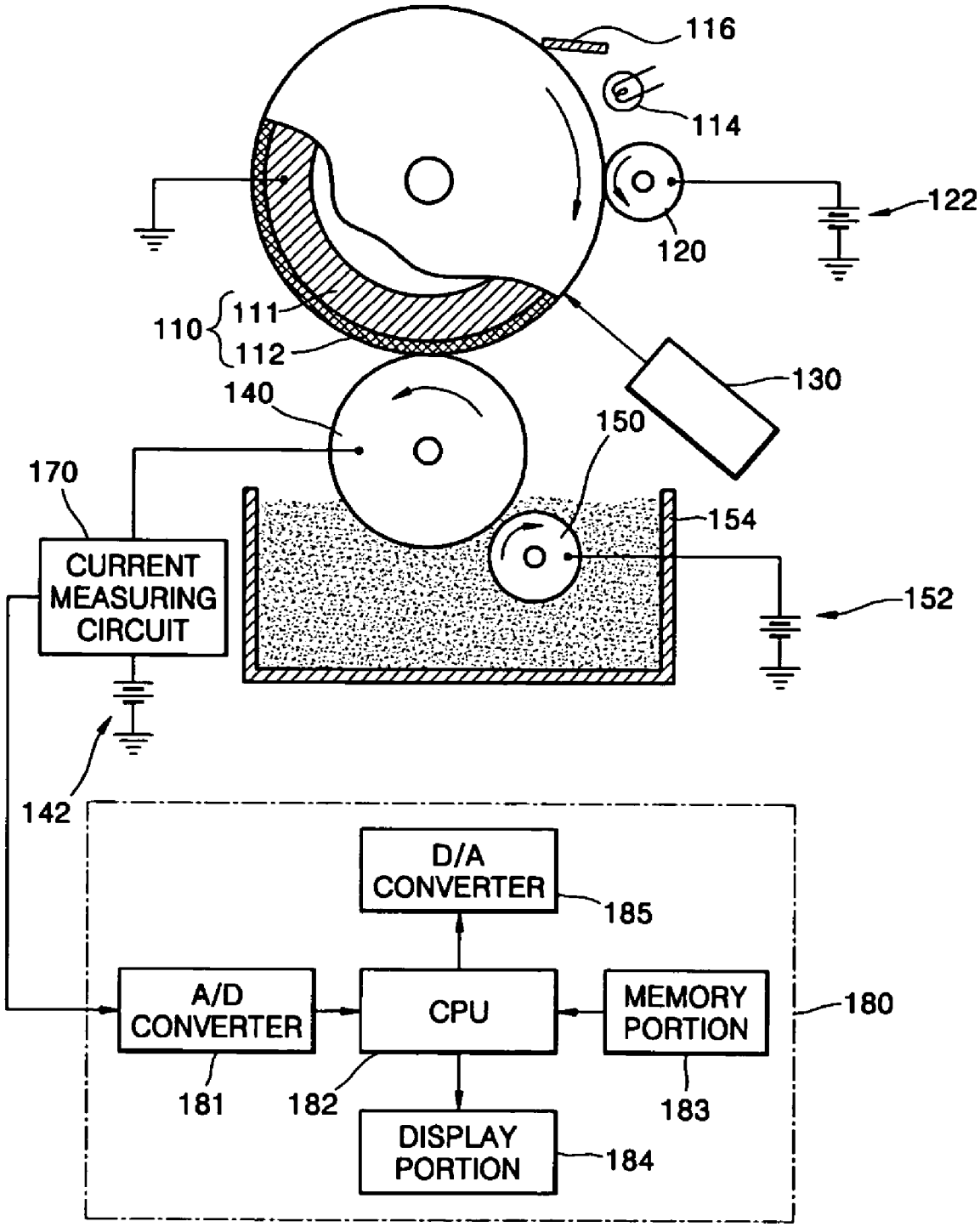
FIG. 3 is a diagram illustrating conditions for measuring a developing current in a first mode of a method of controlling development according to another embodiment of the present invention.
Figure 4:
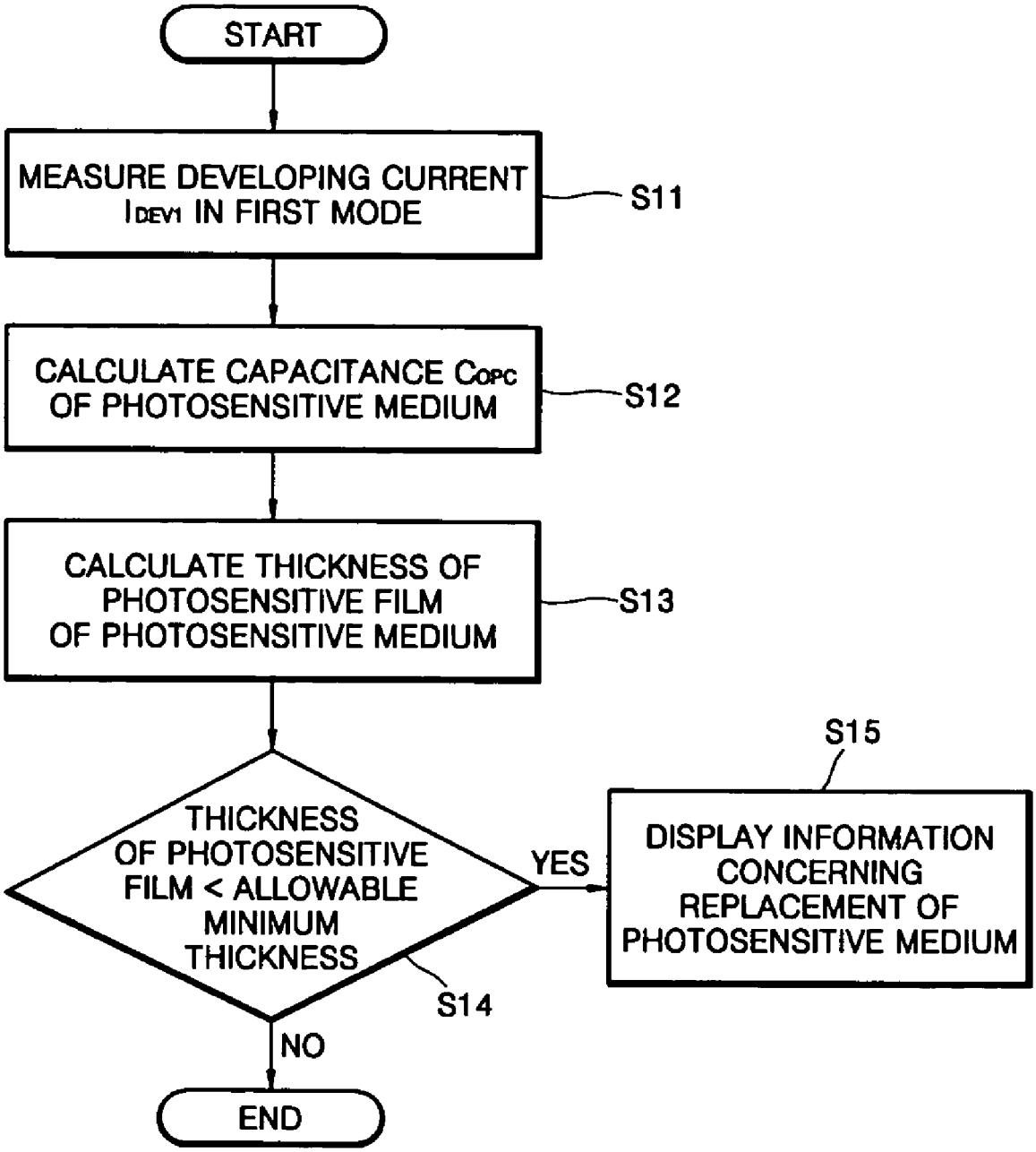
FIG. 4 is a flowchart illustrating the first mode of the method of controlling development according to the embodiment of FIG. 3.

FIG. 3 is a diagram illustrating conditions for measuring a developing current in a first mode of the method of controlling development according to an embodiment of the present invention, and FIG. 4 is a flowchart illustrating the first mode of the method of controlling development according to FIG. 3. In the first mode of the method of controlling development according to FIG. 3, a developing current $I_{DEV1}$ is measured and the thickness of the photosensitive film 112 of the photosensitive medium 110 is calculated, and thereby information concerning replacement of the photosensitive medium can be obtained.

Referring to FIGS. 2, 3 and 4, in the first mode, the surface of the photosensitive medium 110 is charged by the charging roller 120 up to the charged potential $V_{CHA}$ of about 900 volts, and the developing potential $V_{DEV}$ of about 400~500 volts is applied to the developing roller 140. At this time, since the exposure unit 130 is in an off state, an electrostatic image is not formed on the photosensitive medium 110, and since any potential is not applied to the developer supplying roller 150, toner is not supplied to the surface of the developing roller 140. In addition, the developing current $I_{DEV1}$ flows from the photosensitive medium 110 having a higher potential to the developing roller 140. In such a state of the first mode, a value representing the developing current $I_{DEV1}$ flowing between the photosensitive medium 110 and the developing roller 140 is measured at the current measuring circuit 170 in operation S11.

The measured value of the developing current $I_{DEV1}$ is inputted to the CPU 182 via the A/D converter 181. The CPU 182 calculates the capacitance $C_{OPC}$ of the photosensitive medium 110 by using the measured value of the developing current $I_{DEV}$, and the known values of the charged potential $V_{CHA}$ and the developing potential $V_{DEV}$ according to the following Equations (1) and (2) in operation S12.

$$I_{DEV1}=C_{OPC}\times(V_{CHA}-V_{DEV}) \quad (1)$$

$$C_{OPC}=(V_{CHA}-V_{DEV})/I_{DEV1} \quad (2)$$

The calculated capacitance $C_{OPC}$ is proportional to a surface area A of the photosensitive film 112 and is inversely proportional to a thickness d of the photosensitive film 112 as shown in the following Equation (3). That is, as the thickness d of the photosensitive film 112 decreases due to abrasion by the cleaning blade 116 and the like, the capacitance $C_{OPC}$ increases. In the following Equation (3), $\epsilon$ is a permittivity constant of the photosensitive film 112.

$$C_{OPC}=\epsilon A/d \quad (3)$$

Therefore, the thickness d of the photosensitive film 112 can be calculated using Equation (3) with a value of the capacitance $C_{OPC}$ in operation S13.

Next, the thickness d of the photosensitive film 112 is compared with an allowable minimum thickness of the photosensitive film 112 specified in the lookup table stored in the memory portion 183 in operation S14.

When the thickness d of the photosensitive film 112 is less than the allowable minimum thickness, information concerning replacement of the photosensitive medium 110 is displayed via the display portion 184 so as to inform a user of a replacement time of the photosensitive medium 110 in operation S15.

On the other hand, when the thickness d of the photosensitive film 112 is the same as or greater than the allowable minimum thickness, the first mode of the method of controlling development according to the present invention is ended, and subsequently a normal printing job begins, or a second mode of the method of controlling development according to the present invention is performed.

Figure 5:
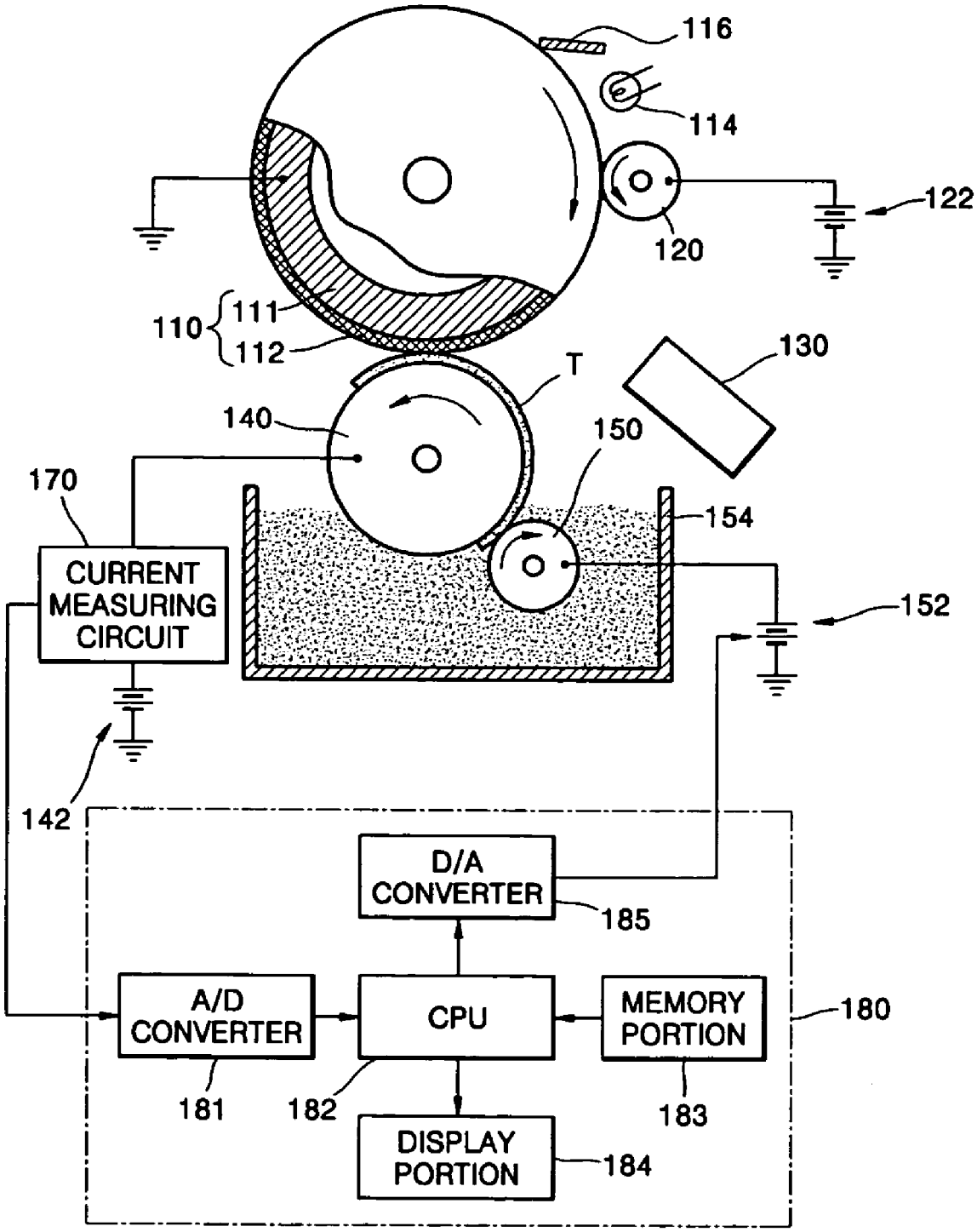
FIG. 5 is a diagram illustrating conditions for measuring a developing current in a second mode of a method of controlling development according to another embodiment of the present invention.
Figure 6:
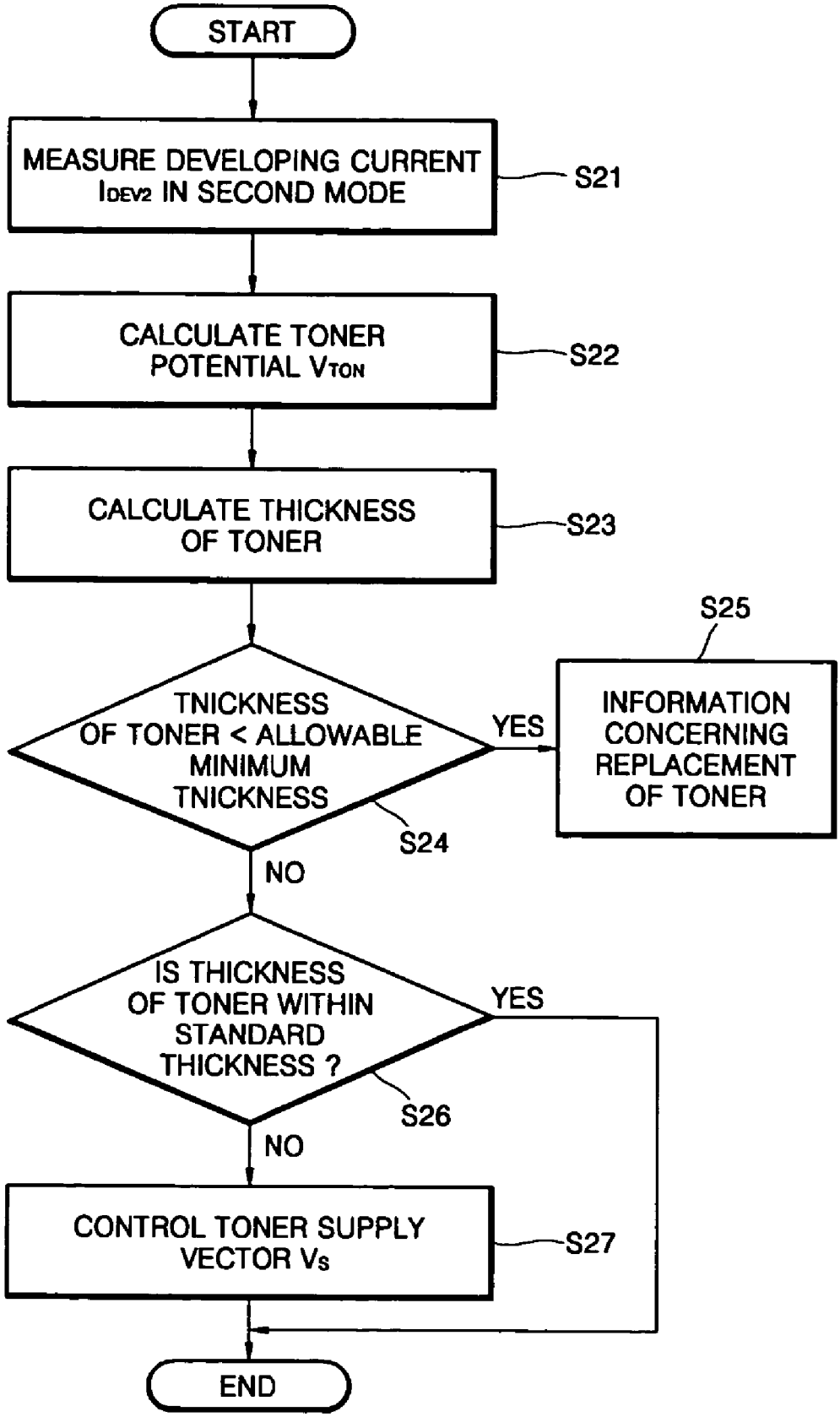
FIG. 6 is a flowchart illustrating the second mode of the method of controlling development according to the embodiment of FIG. 5.

FIG. 5 is a diagram illustrating conditions for measuring the developing current in a second mode of the method of controlling development according to another embodiment of the present invention, and FIG. 6 is a flowchart for describing the second mode of the method of controlling development according to the present invention. In the second mode of the method of controlling development and a developing current $I_{DEV2}$ is measured, the thickness of the toner on the surface of the developing roller is calculated, and thereby information concerning replacement of the toner can be obtained and the toner supply vector $V_S$ can be controlled.

Referring to FIGS. 5 and 6, in the second mode, the surface of the photosensitive medium 110 is charged by the charging roller 120 up to the charged potential $V_{CHA}$ of about 900 volts, the developing potential $V_{DEV}$ of about 400~500 volts is applied to the developing roller 140, and the toner supplying potential $V_S$ up of about 500~700 volts is applied to the toner supplying roller 150. Therefore, since the toner supply vector $V_S$ acts between the developing roller 140 and the toner supplying roller 150, a toner T can be supplied to the surface of the developing roller 140. At this time, since the exposure unit 130 is in the off state, an electrostatic latent image is not formed on the surface of the photosensitive medium 110. In addition, the developing current $I_{DEV2}$ flows from the photosensitive medium 110 having a higher potential to the developing roller 140. In the second mode, a value representing the developing current $I_{DEV2}$ flowing between the photosensitive medium 110 and the developing roller 140 is measured at the current measuring circuit 170 in operation S21.

Since the toner T is positively charged, the surface potential of the developing roller 140 increases as much as the potential $V_{TON}$ of the toner T, and is raised up about 600 volts, and accordingly the developing current $I_{DEV2}$ becomes less than that in the first mode. The measured value of the developing current $I_{DEV2}$ is inputted to the CPU 182 via the A/D converter 181. The CPU 182 calculates the potential $V_{TON}$ of the toner T on the surface of the developing roller 140 by using the measured value of the developing current $I_{DEV2}$, and the known values of the charged potential $V_{CHA}$, the developing potential $V_{DEV}$, and the capacitance $C_{OPC}$ according to the following Equations (4) and (5).

$$I_{DEV2}=C_{OPC}\times(V_{CHA}-V_{DEC}-V_{TON}) \quad (4)$$

$$V_{TON}=V_{CHA}-V_{DEC}-I_{DEV2}/C_{OPC} \quad (5)$$

Next, a thickness of the toner T attached to the surface of the developing roller 140 is calculated using the potential $V_{TON}$ of the toner T in operation S23. The potential $V_{TON}$ of the toner T generally increases as the thickness of the toner T attached to the surface of the developing roller 140 becomes greater. When the potential $V_{TON}$ of the toner T is proportional to the thickness of the toner T, a proportional expression concerning a relationship between the potential $V_{TON}$ of the toner T and the thickness of the toner T can be obtained, and when the proportional expression is used, the thickness of the toner T attached to the surface of the developing roller 140 can be calculated using the potential $V_{TON}$ of the toner T. On the other hand, when the potential $V_{TON}$ of the toner T is not proportional to the thickness of the toner T, the above proportional expression cannot be obtained. In this case, after data concerning variations in the potential $V_{TON}$ of the toner T with respect to increase and decrease of the thickness of the toner T are stored in advance in the memory portion 183 as a lookup table, the thickness of the toner T can be estimated by comparing the calculated potential $V_{TON}$ of the toner T with the stored data in the lookup table.

Next, the thickness of the toner T is compared with the allowable minimum thickness of the toner specified in the lookup table stored in the memory portion 183 in operation S24.

When the thickness of the toner T is less than the allowable minimum thickness, information concerning replacement of the toner is displayed via the display portion 184 so as to inform a user of a replacement time of toner in operation S25.

On the other hand, even in a case that the thickness of the toner T is the same as or greater than the allowable minimum thickness, when the thickness of the toner T is beyond a standard thickness range, it is preferable that the thickness of the toner T is controlled so that an appropriate quality of an image can be obtained.

To this end, when the thickness of the toner T is the same as or greater than the allowable minimum thickness, it is decided whether or not the thickness of the toner T is within the standard thickness range of the toner T specified in the lookup table stored in the memory portion 183 in operation S26. The standard thickness range is a preset thickness range of the toner T to be able to get an appropriate image quality.

When the thickness of the toner T is out of the standard thickness range, the toner supply vector $V_S$ is controlled so that the thickness of the toner T can be within the standard thickness range in operation S27. Since the toner supply vector $V_S$ is defined as a difference between the toner supplying potential $V_{SUP}$ and the developing potential $V_{DEV}$, as shown in the following equation (6) for example, the quantity of the toner T supplied to the developing roller 140 is increased when the toner supply vector $V_S$ is increased, and accordingly the thickness of the toner T attached to the surface of the developing roller 140 is increased. At this time, since a change in the developing potential $V_{DEV}$ affects the development vector $V_D$, it is preferable that increase or decrease of the toner supply vector $V_S$ is achieved by controlling the toner supplying potential $V_{SUP}$. In addition, data concerning variations in the thickness of the toner T with respect to increase and decrease of the toner supplying potential $V_{SUP}$ are stored in advance in the memory portion 183 as an lookup table, and the data is used for controlling the toner supply vector $V_S$.

$$V_S=V_{SUP}-V_{DEV} \quad (6)$$

On the other hand, when the thickness of the toner T is within the standard thickness range, the second mode of the method of controlling development according to the present invention is ended, and subsequently a normal printing job begins, or a third mode of the method of controlling development according to the present invention is performed.

Figure 7:
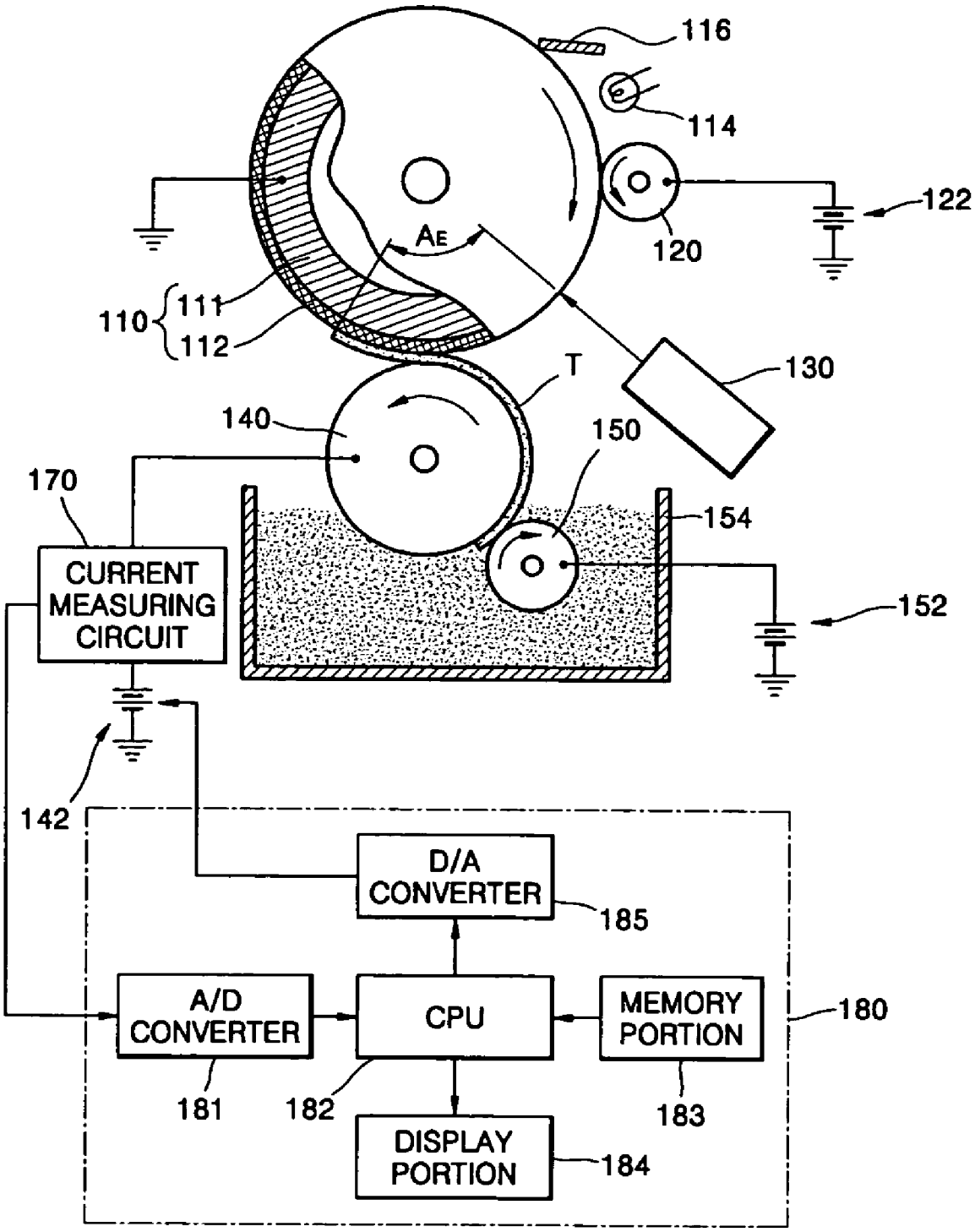
FIG. 7 is a diagram illustrating conditions for measuring a developing current in a third mode of a method of controlling development according to another embodiment of the present invention.
Figure 8:
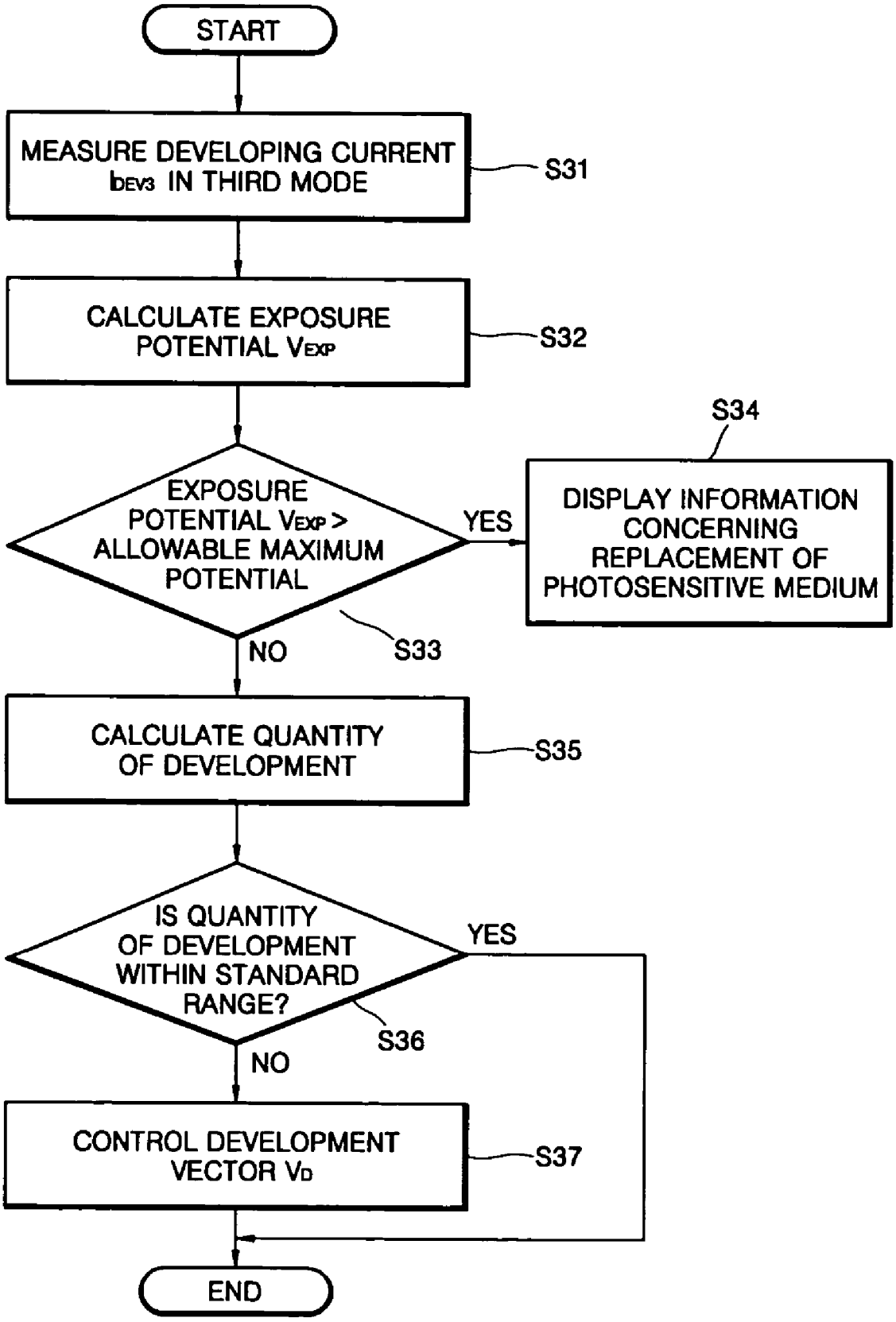
FIG. 8 is a flowchart illustrating the third mode of method of controlling development according to the embodiment of FIG. 7.

FIG. 7 is a diagram illustrating conditions for measuring a developing current in the third mode of the method of controlling development according to the present invention, and FIG. 8 is a flowchart illustrating the third mode of the method of controlling development according to the present invention. In the third mode of the method of controlling development, a developing current $I_{DEV3}$ is measured, the quantity of development on the surface of the photosensitive medium 110 is calculated, and thereby the development vector $V_D$ can be controlled, and information concerning replacement of the photosensitive medium 110 can be obtained.

Referring to FIGS. 7 and 8, in the third mode, the developing potential $V_{DEV}$ of about 400~500 volts is applied to the developing roller 140, and the toner supply potential $V_{SUP}$ of about 500~700 volts is applied to the toner supplying roller 150. Therefore, since the toner supply vector $V_S$ acts between the developing roller 140 and the toner supplying roller 150, the toner T can be supplied to the surface of the developing roller 140. In addition, the surface of the photosensitive medium 110 charged by the charging roller 120 to about 900 volts, and the exposure unit 130 scans a light beam over the surface of the photosensitive medium 110 to form an electrostatic latent image $A_E$ having the exposed potential $V_{EXP}$. Therefore, since the development vector $V_D$ acts between the developing roller 140 and the electrostatic latent image $A_E$, the toner T on the surface of the developing roller 140 is moved to the photosensitive medium 110 to be attached to the electrostatic latent image $A_E$. At this time, the developing current $I_{DEV3}$ flows from the developing roller 140 having a higher potential to the photosensitive medium 110. In the third mode, a value representing the developing current $I_{DEV3}$ flowing between the developing roller 140 and the photosensitive medium 110 is measured at the current measuring circuit 170 in operation S31.

The measured value of the developing current $I_{DEV3}$ is inputted into the CPU 182 via the A/D converter 181. The CPU 182 calculates the exposure potential $V_{EXP}$ of the electrostatic latent image $A_E$ using the measured value of the developing current $I_{DEV3}$, and the known values of the developing potential $V_{DEV}$, the toner potential $V_{TON}$, and the capacitance $C_{OPC}$ according to Equations (7) and (8) in operation S32.

$$I_{DEV3}=C_{OPC}\times(V_{DEV}-V_{TON}-V_{EXP}) \quad (7)$$

$$V_{EXP}=V_{DEV}-V_{TON}-(I_{DEV3}/C_{OPC}) \quad (8)$$

In general, since the characteristics of the photosensitive film 112 of the photosensitive medium 110 deteriorate as the accumulated total number of printed papers increases, the exposure potential $V_{EXP}$ increases gradually. When the characteristics of the photosensitive film 112 deteriorates badly to cause the exposure potential $V_{EXP}$ to increase beyond a predetermined limit, the exposure potential $V_{EXP}$ is out of a controllable range of the development vector $V_D$, and the quantity of development cannot be controlled properly. Therefore, it is preferable that when the exposure potential $V_{EXP}$ increases beyond the predetermined limit, the photosensitive medium 110 is replaced with a new one.

To this end, the calculated exposure potential $V_{EXP}$ is compared with an allowable maximum potential of the exposure potential $V_{EXP}$ specified in the lookup table stored in the memory portion 183 in operation S33.

When the calculated exposure potential $V_{EXP}$ is greater than the allowable maximum potential, information concerning replacement of the photosensitive medium 110 is displayed via the display portion 184 so as to inform a user of a replacement time of the photosensitive medium 110 in operation S34.

On the other hand, when the calculated exposure potential $V_{EXP}$ is the same as or smaller than the allowable maximum potential, the quantity of development is calculated using the exposure potential $V_{EXP}$ in operation S35. As the exposure potential $V_{EXP}$ becomes greater, the development vector $V_D$ defined by the following Equation 9 becomes smaller. Therefore, the quantity of development on the surface of the photosensitive medium 110 generally decreases. When the quantity of development is proportional to the development vector $V_D$, a proportional expression concerning a relationship between the development vector $V_D$ and the quantity of development can be obtained, and when the proportional expression is used, the quantity of development can be calculated using the development vector $V_D$. On the other hand, when the quantity of development is not proportional to the development vector $V_D$, the proportional expression cannot be obtained. In this case, after data concerning variations in the quantity of development with respect to increase and decrease of the exposure potential $V_{EXP}$ are stored in advance in the memory portion 183 as a lookup table, the quantity of development can be estimated by comparing the calculated exposure potential $V_{EXP}$ with the data stored in the lookup table.

$$V_D = V_{DEV} + V_{TON} - V_{EXP} \tag{9}$$

Next, it is decided whether or not the estimated quantity of development is within a standard range of the quantity of development specified in the lookup table stored in the memory portion 183 in operation S36. The standard range is a preset range of the quantity of development so that an appropriate image quality can be obtained.

When the estimated quantity of development is out of the standard range, the development vector $V_D$ is controlled so that the quantity of development can be within the standard range in operation S37. Since the development vector $V_D$ is defined as in the above Equation (9), increase or decrease of the development vector $V_D$ can be achieved by controlling the developing potential $V_{DEV}$. In addition, data concerning variations in the quantity of development with respect to increase and decrease of the development vector $V_D$ are stored in advance in the memory portion 183 as a lookup table, and the data are used to control the development vector $V_D$.

On the other hand, when the estimated quantity of development is within the standard range, the third mode of the method of controlling development according to the present invention ends.

In the above descriptions, the three modes of the method of controlling development according to the present invention have been described individually. However, the three modes of the method of controlling development according to the present invention can be performed together as previously mentioned.

Now, the method of controlling development according to the present invention in which the three modes are performed together will be described briefly with reference to FIGS. 3 through 8. Detailed descriptions of respective operations are the same as those described above.

First, the first, second and third developing currents $I_{DEV1}$, $I_{DEV2}$ and $I_{DEV3}$ are measured in the first mode, the second mode, and the third mode, respectively in operations S11, S21, and S31.

The measured values of the first, second and third developing currents $I_{DEV1}$, $I_{DEV2}$ and $I_{DEV3}$ measured at the current measuring circuit 170 are inputted into the CPU 182 via the A/D converter 181. The CPU 182 calculates the capacitance $C_{OPC}$ of the photosensitive medium 110 using the measured value of the first developing current $I_{DEV1}$ measured in the first mode, calculates the potential $V_{TON}$ of the toner T on the developing roller 140 using the measured value of the second developing current $I_{DEV2}$ measured in the second mode and the capacitance $C_{OPC}$, and calculates the exposure potential $V_{EXP}$ of the electrostatic latent image $A_E$ formed on the surface of the photosensitive medium 110 using the measured value of the third developing current $I_{DEV3}$ measured in the third mode, the potential $V_{TON}$ of the toner T and the capacitance $C_{OPC}$ in operations S12, S22, and S32.

Next, the thickness d of the photosensitive film 112 of the photosensitive medium 110 is calculated using the capacitance $C_{OPC}$, the thickness of the toner T attached to the surface of the developing roller 140 is calculated using the potential $V_{TON}$ of the toner T, and the quantity of development is calculated using the exposure potential $V_{EXP}$ in operations S13, S23, and S35.

Thereafter, the calculated thickness d of the photosensitive film 112 is compared with the allowable minimum thickness of the photosensitive film 112 specified in the lookup table stored in the memory portion 183 in operation S14. When the thickness d of the photosensitive film 112 is smaller than the allowable minimum thickness, information concerning replacement of the photosensitive medium 110 is displayed via the display portion 184 in operation S15.

Subsequently, the calculated thickness of the toner T is compared with the allowable minimum thickness of the toner T specified in the lookup table stored in the memory portion 183 in operation S24. When the thickness of the toner T is smaller than the allowable minimum thickness, information concerning replacement of the toner T is displayed via the display portion 184 in operation S25.

In addition, it is decided whether or not the calculated quantity of development is within the standard range of the quantity of development specified in the lookup table stored in the memory portion 183 in operation S36. When the quantity of development is out of the standard range, the development vector $V_D$ is controlled so that the quantity of development can be within the standard range in operation S37.

In addition, after the exposure potential $V_{EXP}$ is calculated in operation S31, the method further comprises the operation S33 of comparing the exposure potential $V_{EXP}$ with the allowable maximum potential of the exposure potential $V_{EXP}$ specified in the lookup table stored in the memory portion 183, and the operation S34 of displaying information concerning replacement of the photosensitive medium 110 via the display portion 184 when the calculated exposure potential $V_{EXP}$ is greater than the allowable maximum potential.

In addition, when the thickness of the toner T is the same as or greater than the allowable minimum thickness in the operation S24, the method further comprises the operation S26 of deciding whether or not the thickness of the toner T is within the standard thickness range of the toner T specified in the lookup table stored in the memory portion 183, and the operation 27 of controlling the toner supply vector $V_S$ so that the thickness of the toner T can be within the standard thickness range when the thickness of the toner T is out of the standard thickness range.

As described above, with the electrophotographic image forming apparatus and the method of controlling development according to the present invention, a user can be informed in advance of information concerning replacement of consumables such as the photosensitive medium, toner and the like since the developing current flowing between the developing roller and the photosensitive medium is measured, and it can be decided by using the measured developing current whether or not the thickness of the photosensitive film is greater than the allowable minimum thickness, and the toner is consumed. In addition, since the thickness of the developer on the surface of the developing roller and the quantity of development on the surface of the photosensitive medium can be effectively controlled using the measured developing current, an image of a good quality can be obtained.

The present invention can be applied to both dry type and wet type image forming apparatuses, and also can be applied to a colour image forming apparatus. Further, the three modes of the method of controlling development according to the present invention may be performed individually, and two or three modes may be performed together.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An electrophotographic image forming apparatus comprising:

a photosensitive medium;

a charging unit to charge a surface of the photosensitive medium to a uniform potential;

an exposure unit to scan light over the surface of the photosensitive medium to form an electrostatic latent image on the surface of the photosensitive medium;

a developing roller to develop the electrostatic latent image by applying a developer to the electrostatic latent image;

a developer supplying roller to supply the developer to the developing roller;

a transfer unit to transfer the developed image on the surface of the photosensitive medium to a sheet of print paper;

a current measuring unit to measure a developing current flowing between the developing roller and the photosensitive medium; and a controlling unit to calculate a value representing at least one of a thickness of a photosensitive film of the photosensitive medium, a thickness of the developer on a surface of the developing roller, and a quantity of development on the surface of the photosensitive medium using the measured developing current, and to display information concerning replacement of a consumable or to control development parameters according to the calculated value.

2. The electrophotographic image forming apparatus according to claim 1, wherein the current measuring unit is a current measuring circuit provided between the developing roller and a developing power source applying a developing potential to the developing roller.

3. The electrophotographic image forming apparatus according to claim 1, wherein the current measuring unit measures values representing first, second and third developing currents in three modes, respectively, and the three measured values of the first, second, and third developing currents are used in the controlling unit to calculate the thickness of the photosensitive film of the photosensitive medium, the thickness of the developer on the surface of the developing roller, and the quantity of development on the surface of the photosensitive medium.

4. The electrophotographic image forming apparatus according to claim 3, wherein the three modes comprise:

a first mode in which the first developing current is measured in a state in which the photosensitive medium is charged to a charged potential, and a developing potential is applied to the developing roller;

a second mode in which the second developing current is measured in a state in which a developer supplying potential is applied to the developer supplying roller, and the developer is supplied to the surface of the developing roller in addition to the state of the first mode; and a third mode in which the third developing current is measured in a state in which an electrostatic latent image is formed on the photosensitive medium, and the developer is attached to the electrostatic latent image in addition to the state of the second mode.

5. The electrophotographic image forming apparatus according to claim 1, wherein the controlling unit comprises:

a CPU which calculates desired values using the measured developing current, determine whether the consumable must be replaced by comparing the calculated values with preset standard values, and controls the development parameters;

a memory portion to store a lookup table having the standard values to be referenced by the CPU; and a display portion to display information concerning replacement of the consumable according to determination of the CPU concerning whether the consumable must be replaced.

6. The electrophotographic image forming apparatus according to claim 1, wherein the information concerning replacement of the consumable includes information concerning replacement of the photosensitive medium and information concerning replacement of the developer.

7. The electrophotographic image forming apparatus according to claim 1, wherein the development parameters includes a developer supply vector and a development vector.

8. A method of controlling development in an electrophotographic image forming apparatus comprising:

measuring a developing current flowing between a photosensitive medium and a developing roller in a state in which a surface of the photosensitive medium is charged to a charged potential, and a developing potential is applied to the developing roller;

calculating a capacitance of the photosensitive medium using the measured developing current, the charged potential, and the developing potential;

calculating a thickness of a photosensitive film of the photosensitive medium using the capacitance;

comparing the thickness of the photosensitive film with a preset allowable minimum thickness; and displaying information concerning replacement of the photosensitive medium with a new one when the thickness of the photosensitive film is less than the allowable minimum thickness.

9. A method of controlling development in an electrophotographic image forming apparatus comprising:

measuring a developing current flowing between a photosensitive medium and a developing roller in a state in which a surface of the photosensitive medium is charged to a charged potential, and a developing potential and a developer supplying potential are applied to the developing roller and a developer supplying roller, respectively, so that a developer can be supplied to a surface of the developing roller;

calculating a potential of the developer on the surface of the developing roller using the measured developing current, the charged potential, the developing potential, and a capacitance of the photosensitive medium;

calculating a thickness of the developer on the surface of the developing roller using the potential of the developer;

comparing the thickness of the developer with a preset allowable minimum thickness; and displaying information concerning replacement of the developer when the thickness of the developer is thinner than a preset allowable minimum thickness.

10. The method of controlling development in an electrophotographic image forming apparatus according to claim 9, wherein after the displaying operation, the method further comprises:

determining whether the thickness of the developer is within a preset standard thickness range when the thickness of the developer is the same as or greater than the allowable minimum thickness; and controlling a developer supply vector so that the thickness of the developer can be within the standard thickness range when the thickness of the developer is out of the standard thickness range.

11. The method of controlling development in an electrophotographic image forming apparatus according to claim 10, wherein in the controlling operation of the developer supply vector, the developer supply vector is controlled by controlling the developer supplying potential.

12. The method of controlling development in an electrophotographic image forming apparatus according to claim 10, wherein in the controlling operation of the developer supply vector, the developer supply vector is controlled using data concerning variations in the thickness of the developer with respect to increase and decrease of the developer supply vector, and the data are stored in advance in a lookup table.

13. The method of controlling development in an electrophotographic image forming apparatus according to claim 9, wherein in the calculating operation of the thickness the developer, the thickness of the developer is calculated by a proportional expression concerning a relationship between the potential of the developer and the thickness of the developer.

14. The method of controlling development in an electrophotographic image forming apparatus according to claim 9, wherein in the calculating operation of the thickness of the developer, the thickness of the developer is calculated by comparing the potential of the developer calculated in the calculating operation of the potential of the developer with data concerning variations in the thickness of the developer with respect to increase and decrease of a developer supply vector, wherein the data are stored in advance in a lookup table.

15. A method of controlling development in an electrophotographic image forming apparatus comprising:

measuring a developing current flowing between a photosensitive medium and a developing roller in a state in which an electrostatic latent image is formed on a surface of the photosensitive medium, a developing potential and a developer supplying potential are applied to the developing roller and a developer supplying roller, respectively, and a developer is supplied to a surface of the developing roller so that the developer can be attached to the electrostatic latent image;

calculating an exposure potential of the electrostatic latent image using the measured developing current, the developing potential, the potential of the developer, and a capacitance of the photosensitive medium;

calculating a quantity of development on the surface of the photosensitive medium using the exposure potential;

determining whether the quantity of development is within a preset standard range; and controlling a development vector so that the quantity of development can be within the standard range when the quantity of development is out of the standard range.

16. The method of controlling development in an electrophotographic image forming apparatus according to claim 15, wherein after the calculating operation of the exposure potential of the electrostatic latent image, the method further comprises:

comparing the exposure potential with a preset allowable maximum potential; and displaying information concerning replacement of the photosensitive medium when the exposure potential is greater than the allowable maximum potential.

17. The method of controlling development in an electrophotographic image forming apparatus according to claim 15, wherein in the calculating operation of the quantity of development, the quantity of development is calculated using a proportional expression concerning the relation between a development vector and the quantity of development with the exposure potential.

18. The method of controlling development in an electrophotographic image forming apparatus according to claim 15, wherein in the calculating operation of the quantity of development, the quantity of development is calculated by comparing the exposure potential calculated in the calculating operation of the exposure potential with data concerning variations in the quantity of development with respect to increase and decrease of the exposure potential, and the data is stored in advance in a lookup table.

19. The method of controlling development in an electrophotographic image forming apparatus according to claim 15, wherein in the controlling operation of the development vector, the development vector is controlled by controlling the developing potential.

20. The method of controlling development in an electrophotographic image forming apparatus according to claim 15, wherein in the controlling operation of the development vector, the development vector is controlled by using data concerning variations in the quantity of development with respect to increase and decrease of the development vector, and the data is stored in advance in a lookup table.

21. A method of controlling development in an electrophotographic image forming apparatus comprising:

measuring developing currents flowing between a photosensitive medium and a developing roller in three modes, respectively;

calculating a capacitance of the photosensitive medium, a potential of developer on a surface of the developing roller, and an exposure potential of an electrostatic latent image using the measured developing currents;

calculating a thickness of a photosensitive film of the photosensitive medium, a thickness of the developer on a surface of the developing roller, and a quantity of development on the photosensitive medium using values calculated in the calculating operation;

comparing the thickness of the photosensitive film with a preset allowable minimum thickness of the photosensitive film, and comparing the thickness of the developer with a preset allowable minimum thickness of the developer;

displaying information concerning replacement of the photosensitive medium when the thickness of the photosensitive film is less than the allowable minimum thickness of the photosensitive film, and displaying information concerning replacement of the developer when the thickness of the developer is less than the allowable minimum thickness of the developer;

determining whether the quantity of development is within a preset standard range; and controlling a development vector so that the quantity of development can be within the standard range when the quantity of development is out of the standard range.

22. The method of controlling development in an electrophotographic image forming apparatus according to claim 21, wherein in the measuring operation, the three modes comprises:

a first mode in which the surface of the photosensitive medium is charged to a charged potential, and a developing potential is applied to the developing roller;

a second mode in which a developer supplying potential is applied to a developer supplying roller so that the developer can be applied to the surface of the developing roller in addition to the state of the first mode; and a third mode in which an electrostatic latent image is formed on the surface of the photosensitive medium so that the developer can be attached to the electrostatic latent image in addition to the state of the second mode.

23. The method of controlling development in an electrophotographic image forming apparatus according to claim 22, wherein the calculating operation of the capacitance of the photosensitive medium comprises calculating the capacitance of the photosensitive medium using a first developing current measured in the first mode, calculating the potential of the developer on the surface of the developing roller using a second developing current measured in the second mode, and the calculated capacitance, and calculating the exposure potential of the electrostatic latent image formed on the surface of the photosensitive medium using a third developing current measured in the third mode, the calculated capacitance, and the calculated potential of the developer.

24. The method of controlling development in an electrophotographic image forming apparatus according to claim 21, wherein in the calculating operation of the thickness of the photosensitive drum, the thickness of the photosensitive film is calculated using the capacitance of the photosensitive medium, the thickness of the developer on the surface of the developing roller using the potential of the developer, and the quantity of development is calculated using the exposure potential.

25. The method of controlling development in an electrophotographic image forming apparatus according to claim 21, wherein in the controlling operation of the development vector, the development vector is controlled by controlling the developing potential.

26. The method of controlling development in an electrophotographic image forming apparatus according to claim 21, wherein after the calculating operation of the capacitance of the photosensitive medium, the method further comprises:

comparing the exposure potential with a preset allowable maximum potential; and displaying information concerning replacement of the photosensitive medium when the exposure potential is greater than the allowable maximum potential.

27. The method of controlling development in an electrophotographic image forming apparatus according to claim 21, wherein after the displaying operation of the information, the method further comprises:

determining whether the thickness of the developer is within a preset standard thickness range when the thickness of the developer is the same as or greater than the allowable minimum thickness; and controlling a developer supply vector so that the thickness of the developer can be within the standard thickness range when the thickness of the developer is out of the standard thickness range.

28. The method of controlling development in an electrophotographic image forming apparatus according to claim 27, wherein the developer supply vector is controlled by controlling the developer supplying potential.

29. A method of controlling development in an electrophotographic image forming apparatus, the method comprising:

measuring a developing current flowing between a developing roller and a photosensitive medium;

calculating a value representing at least one of a thickness of a photosensitive film of the photosensitive medium, a thickness of a developer on a surface of the developing roller, and a quantity of development on the surface of the photosensitive medium using the measured developing current; and generating information concerning replacement of at least one of the photosensitive medium, the developing roller, and the developer, according to the calculated value.

30. The method of controlling development in the electrophotographic image forming apparatus according to claim 29, further comprising:

controlling development parameters according to the calculated value to control development on the photosensitive medium.

31. The method of controlling development in the electrophotographic image forming apparatus according to claim 29, wherein the calculating operation comprises:

calculating a capacitance of the photosensitive medium using the measured developing current, a potential of a developer using the measured developing current and the capacitance of the photosensitive medium, and an exposure potential of an electrostatic latent image formed on a surface of the photosensitive medium using the measured developing current and the potential of the developer and the capacitance of the photosensitive medium.

32. The method of controlling development in the electrophotographic image forming apparatus according to claim 31, wherein the calculating operation comprises:

calculating the thickness of the photosensitive film of the photosensitive medium using the capacitance of the photosensitive medium, the thickness of the developer attached to the surface of the photosensitive medium using the potential of the developer, and the quantity of the development using the exposure potential of the photosensitive medium.

33. The method of controlling development in the electrophotographic image forming apparatus according to claim 32, wherein the generating operation comprises:

comparing the thickness of the photosensitive film of the photosensitive medium with a first reference value, the thickness of the developer attached to the surface of the photosensitive medium with a second reference value, and the quantity of the development with a third reference value to generate a signal representing the information.

34. An electrophotographic image forming apparatus comprising:

a photosensitive medium;

a charging unit to charge a surface of the photosensitive medium to a uniform potential;

an exposure unit to scan light over the surface of the photosensitive medium to form an electrostatic latent image on the surface of the photosensitive medium;

a developing roller to develop the electrostatic latent image by applying a developer to the electrostatic latent image;

a developer supplying roller to supply the developer to the developing roller;

a transfer unit to transfer the developed image on the surface of the photosensitive medium to a sheet of print paper;

a current measuring unit to measure a developing current flowing between the developing roller and the photosensitive medium; and a controlling unit to calculate a value representing at least one of a thickness of a photosensitive film of the photosensitive medium in a first mode, a thickness of the developer on a surface of the developing roller in a second mode, and a quantity of development on the surface of the photosensitive medium using the measured developing current in a third mode, and to display information concerning replacement of a consumable or controlling development parameters according to the calculated value, wherein the control unit calculates a capacitance of the photosensitive medium using the measured developing current in the first mode, a potential of a developer using the measured developing current and the capacitance of the photosensitive medium in the second mode, and an exposure potential of an electrostatic latent image formed on a surface of the photosensitive medium using the measured developing current and the potential of the developer and the capacitance of the photosensitive medium in the third mode, calculates the thickness of the photosensitive film of the photosensitive medium using the capacitance of the photosensitive medium in the first mode, the thickness of the developer attached to the surface of the photosensitive medium using the potential of the developer in the second mode, and the quantity of the development using the exposure potential of the photosensitive medium in the third mode, and compares the thickness of the photosensitive film of the photosensitive medium with a first reference value in the first mode, the thickness of the developer attached to the surface of the photosensitive medium with a second reference value in the second mode, and the quantity of the development with a third reference value in the third mode to generate a signal representing the information.

35. A method of controlling development in an electrophotographic image forming apparatus, the method comprising:

measuring a developing current flowing between a developing roller and a photosensitive medium;

calculating a capacitance of the photosensitive medium using the measured developing current in a first mode, a potential of a developer using the measured developing current and the capacitance of the photosensitive medium in a second mode, and an exposure potential of an electrostatic latent image formed on a surface of the photosensitive medium using the measured developing current and the potential of the developer and the capacitance of the photosensitive medium in a third mode;

calculating a value representing at least one of a thickness of the photosensitive film of the photosensitive medium using the capacitance of the photosensitive medium in the first mode, a thickness of the developer attached to the surface of the photosensitive medium using the potential of the developer in the second mode, and a quantity of the development using the exposure potential of the photosensitive medium in the third mode; and comparing the thickness of the photosensitive film of the photosensitive medium with a first reference value in the first mode, the thickness of the developer attached to the surface of the photosensitive medium with a second reference value in the second mode, and the quantity of the development with a third reference value in the third mode, to generate a signal representing the information concerning replacement of a consumable or controlling development parameters, according to the calculated value.

* * * * *